United States Patent [19]

Minor

[11] 4,385,863

[45] May 31, 1983

[54] SEAT INTERLOCK FOR SKID-STEER LOADER

[75] Inventor: Ray C. Minor, Leola, Pa.

[73] Assignee: Sperry Corporation, New Holland, Pa.

[21] Appl. No.: 263,328

[22] Filed: May 13, 1981

[51] Int. Cl.[3] ..... E02F 3/32

[52] U.S. Cl. ..... 414/699; 414/715; 180/273; 200/61.58 B

[58] Field of Search ..... 414/685, 715, 699; 180/273; 200/61.58

[56] References Cited

U.S. PATENT DOCUMENTS

| | | | |
|---|---|---|---|
| 3,487,451 | 12/1969 | Fontaine | 180/273 X |
| 3,749,866 | 7/1973 | Tiazkun et al. | 180/273 X |
| 3,995,761 | 12/1976 | Hurlburt | 414/713 |
| 4,019,602 | 4/1977 | Habiger | 180/273 |
| 4,059,196 | 11/1977 | Uchino et al. | 180/273 X |

*Primary Examiner*—Robert J. Spar
*Assistant Examiner*—Terrance L. Siemens
*Attorney, Agent, or Firm*—Larry W. Miller; Frank A. Seemar; Darrell F. Marquette

[57] ABSTRACT

A seat interlock mechanism for a skid-steer loader is disclosed wherein the boom structure can be rendered inoperable for vertical movement if the operator leaves his seat. The hydraulic circuit for powering the hydraulic cylinders, which move the boom structure in a vertical direction, includes a solenoid valve that is capable of stopping the flow of fluid through the hydraulic circuit and, thereby, prevent the boom structure from vertically moving. An improved seat frame structure, incorporating a switch which senses the presence of an operator on the seat, provides greater sensitivity for the presence of the operator, so that the switch can control the solenoid valve to stop or permit the flow of fluid through the circuit. The improved seat frame includes a first member mounted to the loader frame and a second member biased away from the first member by a spring positioned beneath the center of gravity of that portion of the seat being biased upwardly by the spring. The second member is connected to the first member by a plurality of bolts forming pivot axes forward and rearward of the spring. The switch signals the presence of an operator in the seat when the second member moves towards the first member and engages the switch by the weight of the seat and the operator exceeding the upwardly biasing force of the spring.

9 Claims, 8 Drawing Figures

SEAT INTERLOCK FOR SKID-STEER LOADER

BACKGROUND OF THE INVENTION

The present invention relates generally to loaders and, more particularly, to a seat interlock system to prevent the boom structure from moving vertically when the operator of the loader has left the loader seat.

It has been found that seat interlock devices normally found in the automobile industry, such as those devices which are mounted within the seat cushions, did not provide sufficient sensitivity for use on a skid-steer loader. If the operator chose to sit on certain areas of the seat, such as at the extreme forward edge of the seat, such devices would not always be successful in detecting the presence of the operator on the seat. Similarly, other arrangements, including hinging the seat along either the forward or rearward edges of the seat, did not satisfactorily sense the presence of the operator on the seat.

Accordingly, it would be desirable to provide a seat interlocking mechanism that would be capable of sensing the presence of an operator on the seat of a skid-steer loader, irrespective of where the operators weight is distributed on the seat. Such a seat interlock mechanism should be operable to render the boom structure inoperable for moving vertically relative to the frame of the loader.

SUMMARY OF THE INVENTION

It is an object of the invention to overcome the aforementioned disadvantages of the prior art by providing a seat interlock mechanism for a skid-steer loader that can sense the presence of an operator on the seat of the loader, irrespective of where the operator is sitting on the seat or how his weight is distributed.

It is another object of this invention to provide a seat interlock mechanism for a skid-steer loader which will have greater sensitivity as to the position and distribution of the weight of the operator on the seat.

It is a feature of this invention that the boom structure will not move vertically whenever the operator leaves his seat.

It is an advantage of this invention that the operator can leave his seat and still be able to move the working tool attached to the boom structure forwardly of the loader frame even though the boom structure itself may not move vertically.

It is another object of this invention to provide a seat interlock mechanism that can easily be dismantled, should any of the components thereof fail.

It is still another object of this invention to provide a seat frame having two members with one being moveable relative to the other and being biased away from the other so that a switch can be mounted between the two to sense the movement of one member toward the other.

It is another feature of this invention that the spring biasing the one seat frame member upwardly away from the other is positioned beneath the center of gravity of that portion of the seat being upwardly biased.

It is a further object of this invention to connect the two seat frame members with a plurality of bolts slidably received within the fixed seat frame member and forming a line to each side of the biasing spring, such that the one seat frame member can utilize any of the lines formed by the bolts as the pivot axis to move toward the fixed seat frame member when the weight of the operator is positioned anywhere on the seat.

It is a still further object of this invention to connect the two seat frame members with a plurality of bolts slidably received through the fixed seat frame member so that the one seat frame member can move generally linearly toward the fixed seat frame member.

It is yet a further object of this invention to provide a seat interlock mechanism, having an improved sensitivity to the presence of the operator on the seat to prevent the boom structure from moving vertically when the operator has left the loader seat, which is durable in construction, inexpensive of manufacturing, carefree of maintenance, facile in assemblage, and simple and effective in use.

These and other objects, features and advantages are accomplished according to the instant invention by providing a seat interlock mechanism for a skid-steer loader wherein the boom structure can be rendered inoperable for vertical movement if the operator leaves his seat. The hydraulic circuit for powering the hydraulic cylinders, which move the boom structure in a vertical direction, includes a solenoid valve that is capable of stopping the flow of fluid through the hydraulic circuit and, thereby, prevent the boom structure from vertically moving. An improved seat frame structure, incorporating a switch which senses the presence of an operator on the seat, provides greater sensitivity for the presence of the operator, so that the switch can control the solenoid valve to stop or permit the flow of fluid through the circuit. The improved seat frame includes a first member mounted to the loader frame and a second member biased away from the first member by a spring positioned beneath the center of gravity of that portion of the seat being biased upwardly by the spring. The second member is connected to the first member by a plurality of bolts forming pivot axes forward and rearward of the spring. The switch signals the presence of an operator in the seat when the second member moves towards the first member and engages the switch by the weight of the seat and the operator exceeding the upwardly biasing force of the spring.

BRIEF DESCRIPTION OF THE DRAWINGS

The advantage of this invention will become apparent upon consideration of the following detailed description of the invention, especially when taken in conjunction with the accompanying drawings wherein.

DETAILED DESCRIPTION OF THE PREFERRED EMBODIMENT

Figure 1:
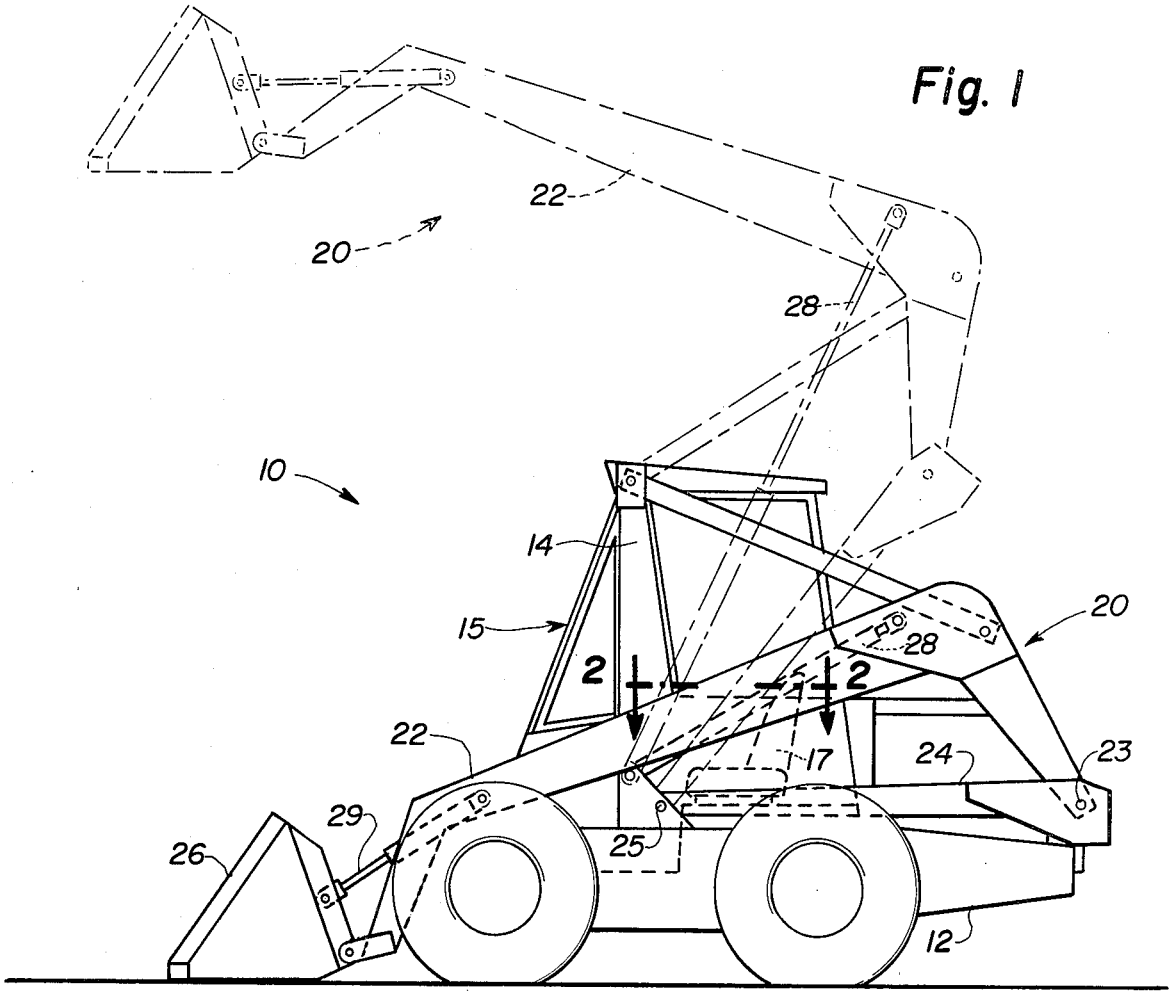
FIG. 1 is a side elevational view of a skid-steer loader incorporating the principals of the instant invention.

Referring now to the drawings and, particularly, to FIG. 1, a side elevational view of a skid-steer loader can be seen. Although the skid-steer loader depicted in FIGS. 1-8 is of the type described in detail in U.S. Pat. No. 3,215,292, issued to L. M. Halls on Nov. 2, 1965, one skilled in the art should readily realize that the principles of the instant invention are not restricted to this particular type of loader.

The loader 10 includes a wheeled frame 12 and spaced apart side walls 14 disposed generally vertically and defining an operator's compartment 15 therebetween. A seat 17 is mounted within the operator's compartment 15 on a floor member 18 extending generally between the spaced apart side walls 14. The boom structure 20 is basically comprised of a pair of spaced apart upper boom arms 22 pivotally connected at pivot 23 to a pair of corresponding lower boom arms 24. The lower boom arms 24 are, in turn, pivotally connected at pivot 25 to the frame 12. Generally, a working tool, such as the bucket 26, is connected to the upper boom arms 22 forwardly of the loader 10. The boom structure 20 is pivoted about 25 and moved in a generally vertical direction, as shown in phantom in FIG. 1, by a pair of hydraulically actuated lift cylinders 28 interconnecting the frame 12 and the upper boom arms 22. The position of the bucket 26 relative to the upper boom arms 22 can be controlled by manipulation of the hydraulic cylinders 29 interconnecting the bucket 26 and the upper boom arms 22.

Figure 2:
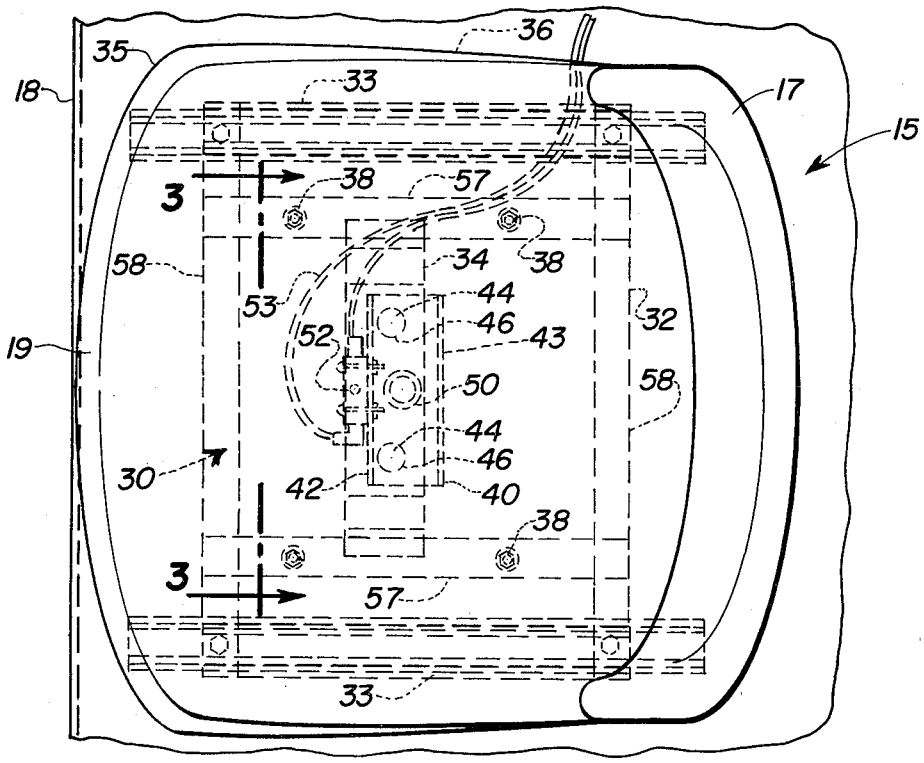
FIG. 2 is a partial cross sectional view of the loader through the operator's compartment taken along lines 2—2 of FIG. 1, showing the operator's seat in top plan view.
Figure 3:
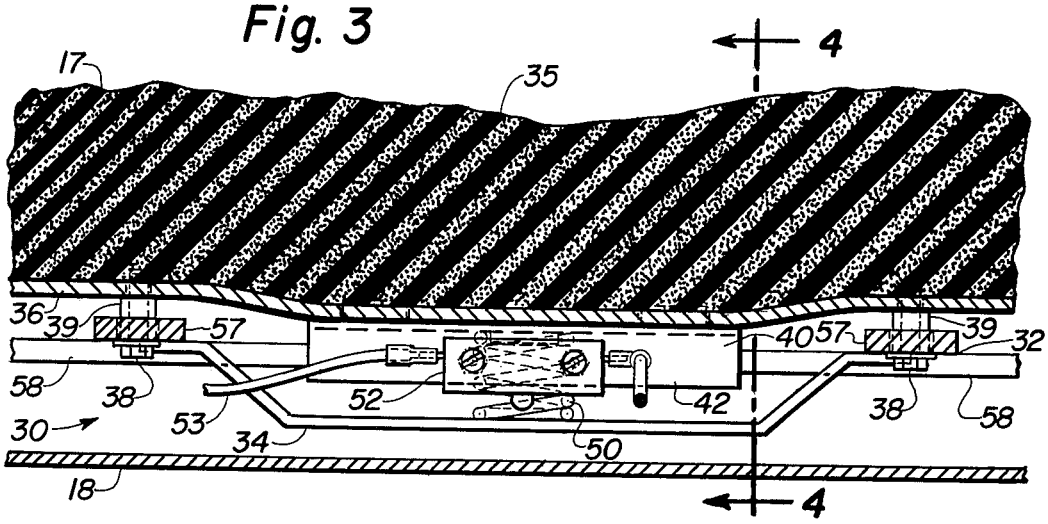
FIG. 3 is a partial cross sectional view of the operator's seat taken along lines 3—3 of FIG. 2 and showing a front elevational view of the instant invention with the seat being empty.
Figure 4:
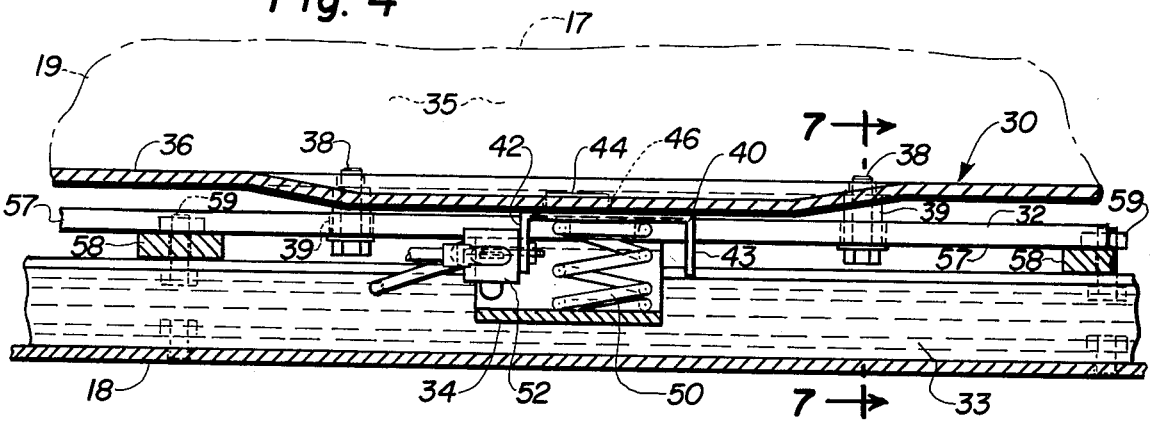
FIG. 4 is a partial cross sectional view of the operator's seat corresponding to lines 4—4 of FIG. 3, the seat being shown in the empty state.

Referring now to FIGS. 2, 3 and 4, the details of the instant invention can readily be seen. The seat frame 30 includes a first seat frame member 32 connected to adjusting rails 33 mounted on the floor 18. The adjusting rails 33 permit the seat 17 to be adjusted in a fore-and-aft direction at the convenience of the operator. The first frame member 32 also includes an actuator plate 34 spaced above the floor 18, the function of which will be described in detail below. The seat cushion 35 is affixed to the second seat frame member 36 which, in turn, is connected to the first seat frame member 32 by a plurality of bolts 38 slidably received through the first seat frame member 32.

A U-shaped bracket 40 is positioned adjacent the second seat frame member 36 in a downwardly facing manner, as best seen in FIG. 4, such that the forward leg 42 is spaced above the actuator plate 34, while the rearward leg 43 is spaced rearwardly of the actuator plate 34. The bracket 40 is fixed into a position relative to the second seat frame member 36 by a protrusion 44 affixed to the bracket 40 and projecting through a weep hole 46 formed in the second seat frame member 36. The weep hole 46 provides a means for draining water from above the second seat frame member 36, as well as providing a means for fixing the position of the bracket 40 relative to the second seat frame member 46.

A spring 50 interposed between the bracket 40 and the actuator plate 34 forces the bracket 40 upwardly into position against the second seat frame member 36 such that the protrusion 44 is disposed within the weep hole 46. The spring 50 biases the second seat frame member 36 upwardly away from the first seat frame member 32 and, as such, is best positioned beneath the center of gravity of that portion of the seat 17 being biased upwardly by the spring 50. The spring 50 is of a size to support a weight at least as great as the weight of that portion of the seat being biased upwardly, so that the second seat frame member 36 is maintained in a spaced relationship to the first seat frame member 32 when the operator's seat is empty.

Figure 5:
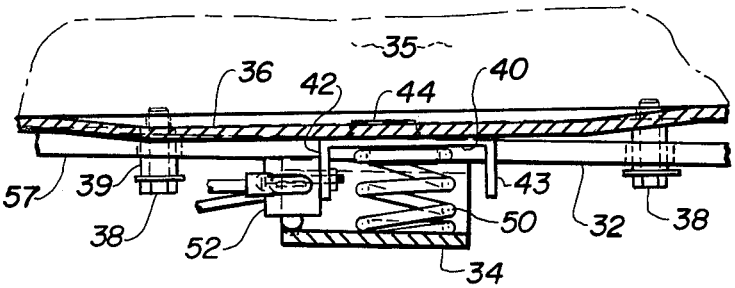
FIG. 5 is a partial cross sectional view corresponding to FIG. 4 and showing the position of the components of the instant invention when an operator is sitting adjacent the forward edge of the operator's seat.
Figure 6:
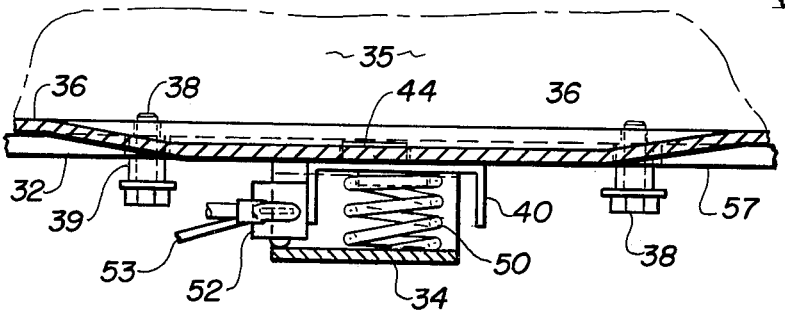
FIG. 6 is a partial cross sectional view corresponding to FIG. 4 showing the position of the components of the instant invention corresponding to the weight of the operator being substantially centered on the operator's seat.
Figure 8:
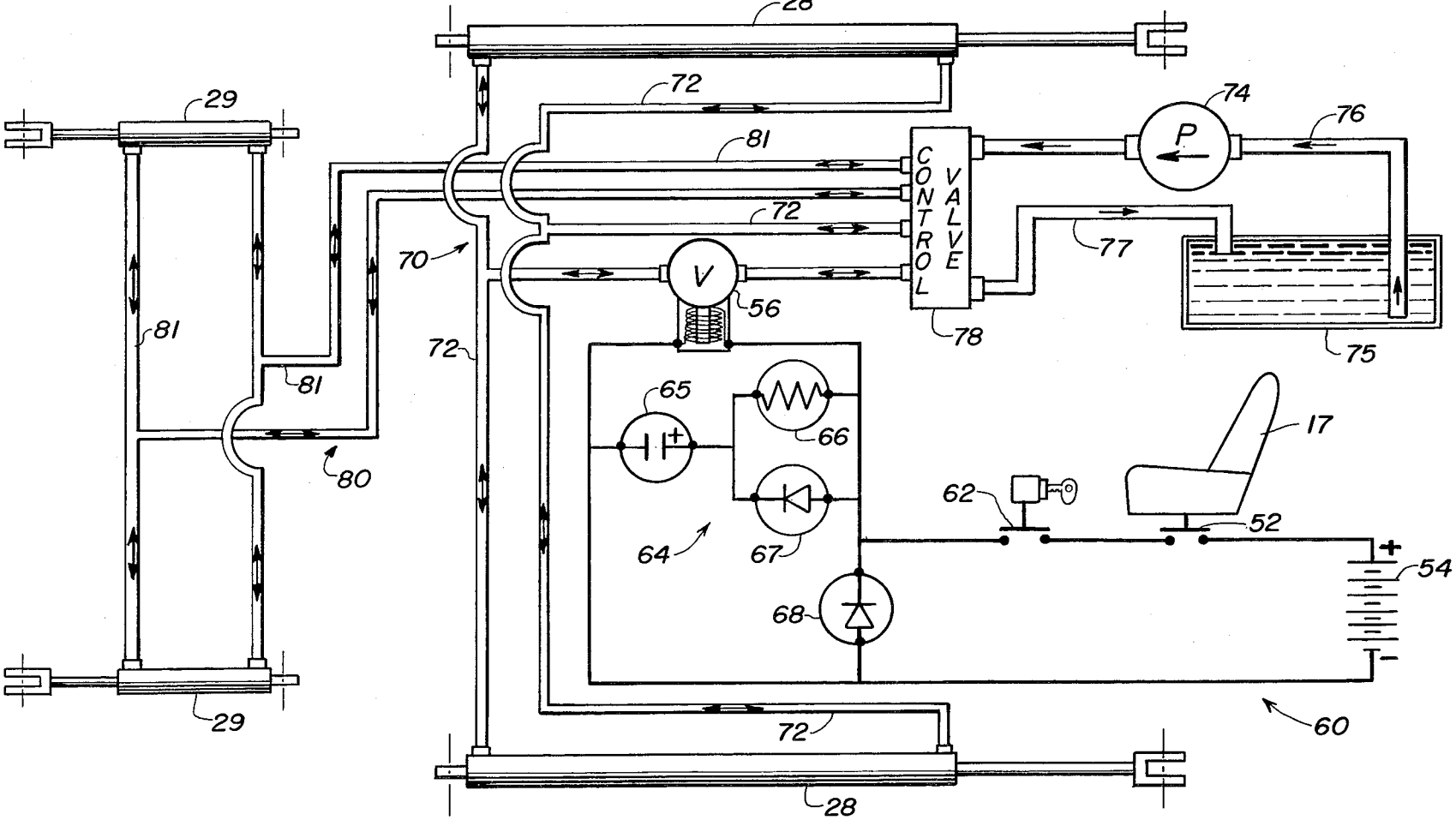
FIG. 8 is a schematic diagram of a portion of the hydraulic and electrical circuits of the skid-steer loader pertaining to the instant invention.

A switch 52 is affixed to the forward leg 42 of the bracket 40 and positioned immediately above the actuator plate 34. When a weight is placed in the seat 17 greater than that which the spring 50 can bias upwardly, the second seat frame member 36 moves into a first position adjacent to the first seat frame member 32, as generally seen in FIGS. 5 and 6, such that the switch 52 engages the actuator plate 34. When no weight is placed on the seat 17, the spring 50 biases the second seat frame member 36 into a second position, as seen generally in FIGS. 3 and 4, spaced from the first seat frame member 32, such that the switch 52 is spaced from the actuator plate 34. The wires 53 connected to the switch 52 form a part of the electrical circuit 60 interconnecting the source of electrical current 54 and a solenoid valve 56, as schematically shown in FIG. 8.

Referring now to FIGS. 5 and 6, the operation of the seat switch sensing the presence of an operator on the loader seat 17 can be seen. More particularly, FIG. 5 depicts the position of the various components when the operator is sitting near the forward edge 19 of the seat 17. The bolts 38 interconnecting the second seat frame member 36 and the first seat frame member 32 are positioned around the spring 50 and switch 52 in such as manner as to form a line on each side thereof. When the operator sits near the forward edge 19 of the seat 17 the bolts 38 forming a line rearwardly of the spring 50, serves somewhat as a pivot axis allowing the second seat frame member 36 to move into the first position adjacent said first seat frame member 32 and cause the switch 52 to become engaged with the actuator plate 34.

Similarly, when the weight of the operator is distributed rearwardly of the spring 50, the bolts 38 positioned forwardly of the spring 50 and forming a line forwardly thereof serves somewhat as a pivot axis, permitting the second seat frame member 36 to move into the first position adjacent the first seat frame member 32 and engage the switch 52 with the actuator plate 34. When the weight of the operator and the loader seat 17 is generally centered between the bolts 38 forwardly of the spring 50 and rearwardly of the spring 50, the bolts 38 slide through the first seat frame member 32 to permit the second seat member 36 to move generally linearly downwardly until the switch 52 engages the actuator plate 34. The first seat frame member 32 serves as a stop for the movement of the second seat frame member 36 so that the switch 52 engages the actuator plate 34 sufficiently to operate the switch 52 but not hard enough to damage the switch 52 by an impact upon the actuator plate 34.

Figure 7:
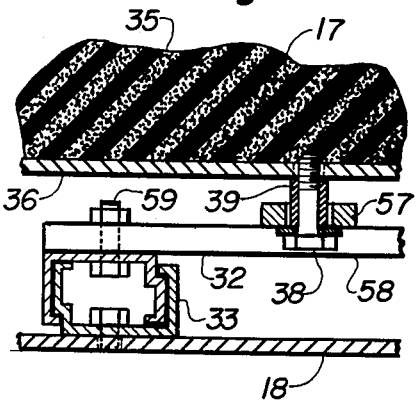
FIG. 7 is a cross sectional view taken along lines 7—7 of FIG. 4 and showing the bolts attaching the second seat frame member to the first seat frame member.

Referring now to FIG. 7, a detail of the mounting of the second seat frame member 36 with the first seat frame member 32, which, in turn, is mounted to the floor 18 of the frame 12, can be seen. The bolt 38 is threaded into the second seat frame member 36 and slidably received through the first seat frame member 32 by means of a spacer 39. The first seat frame member 32 is composed of a series of linear bar-like members 57, 58 arranged at 90 degrees to each other and forming a box-like structure beneath the second seat frame member 36. The linear bar-like members 58 are connected to the adjusting rails 33 by means of bolts 59. As is well known in the art, the adjusting rails 33 is comprised of two members slidably connected to each other and connected to the floor 18 and the first frame member 58, respectively. As noted above, the adjusting rails 33 permit a fore-and-aft adjustment of the operator's seat 17.

Referring now to the schematic diagram of a portion of the hydraulic and electrical circuits of the skid-steer loader 10 as seen in FIG. 8, the operation of the seat interlock mechanism with the boom lock and time delay devices can be seen. In general, the electrical circuit 60 includes a source of electrical current 54 for operating the solenoid valve 56. The ignition switch 62 and the seat switch 52 are diagrammatically shown in the electrical circuit 60. The solenoid valve 56 is situated such that when both the ignition switch 62 and the seat switch 52 are closed to permit electrical current to flow from the source of electrical current 54 to the solenoid valve 56, the solenoid valve is opened to permit an unrestricted flow of fluid through the hydraulic circuit 70 to the boom lift cylinders 28. If either the ignition switch 62 or the seat switch 52 become moved to the open or off position, the flow of electrical current from the source of electrical current 54 to the solenoid valve 56 is interrupted and the solenoid valve assumes a second operating condition, wherein the flow of fliud through the hydraulic circuit 70 to the boom lift cylinders 28 is prevented, thereby locking the boom structure 20 in a fixed position.

During operation of the skid-steer loader 10, the operator may be bounced up and down in the seat 17, causing the seat switch 52 to become disengaged from the actuator plate 34 and, thereby, move into the open or off position. To prevent this bouncing movement from interrupting the operation of the boom structure 20 due to an interruption of the flow of fluid to the hydraulic circuit 70 by the solenoid valve 56, a time delay device 64 is connected to the electrical circuit 60 in parallel with both the source of electrical current 54 and the solenoid valve 56. The time delay device 64 comprises a passive electrical circuit including a capacitor 65 connected in parallel with the energy source 54. To restrict the flow of current from the capacitor 65 to the solenoid valve 56, in the event the switch 52 is temporarily placed in the open or off position and, thereby, interrupting the flow of current from the energy source 54, a resistor 66 is placed in series with the capacitor 65 such that both the capacitor 65 and the resistor 66 are in parallel with the energy source 54 and the solenoid valve 56. The provisions of the resistor 66 meters the discharge of current from the capacitor 65 and enables a capacitor 65 of smaller rating to be utilized. One skilled in the art will readily realize that the time delay device can utilize an active electrical circuit to accomplish the same function; however, the utilization of an active time delay device could conceivably fail in a manner to render the seat switch ineffective. Accordingly, a passive time delay device as described above is deemed preferable.

To permit the source of electrical current 54 to rapidly charge the capacitor 65, once both the ignition switch 62 and the seat switch 52 become closed or in the on position, a diode 67 is placed in series with the capacitor 65 and in parallel with the resistor 66. This arrangement of components permits a rapid flow of current from the energy source 54 through the diode 67 to charge the capacitor 65 while requiring that any discharge from the capacitor 65 to the solenoid valve 56 must be through the resistor 66. A second diode 68 is connected to the electrical circuit 60 in parallel with both the source of electrical current 54 and the solenoid valve 56 between the switches 52, 62 and the solenoid valve 56 to prevent arcing of electrical current over either of the switches 52, 62, when placed in the open or off position, by dissipating the energy stored in the solenoid valve 56.

For a solenoid valve having a resistance of approximately 8 ohms and a dropout voltage of approximately 1.5 volts, it has been found that a capacitor having a rating of 3,300 microfarads and 25 volts D.C. in combination with a 68 ohm, ¼ watt carbon resistor and a 1N4004 diode provides a time delay of approximately 0.3 seconds before an open switch 52 or 62 will effect a movement of the solenoid valve 56 to the second condition, whereby the flow of fluid through the hydraulic circuits 70 is prevented and the boom structure 20 rendered inoperative for any further vertical movement. Although not seen in the drawings, the capacitor 65, the resistor 66 and the diodes 67, 68 can be encapsulated in a plastic tube with a rigid epoxy and mounted on the frame 12 in a convenient location, such as adjacent the solenoid valve.

The hydraulic circuit 70 to the boom lift cylinders 28 includes a pair of supply lines 72 leading to each end of each of the hydraulic boom lift cylinders 28 for the supplying of fluid under pressure thereto. The pump 74 and the reservoir 75, schematically shown in FIG. 8, provide a supply of fluid under pressure to the control valve 78 through the supply line 76 and return line 77. The control valve 78 controls the direction of flow of fluid under pressure through the supply lines 72 to the boom lift cylinders 28. As is well known in the art, the extension and contraction of the length of the hydraulic cylinder 28 depends upon which end of the hydraulic cylinder fluid is supplied under pressure.

The hydraulic circuit 80 for the bucket cylinders 29 includes a pair of supply lines 81 leading between the control valve 78 and the bucket cylinders 29. Operation of the bucket cylinders 29 is well known in the art and is generally identical to the description noted above relative to the boom lift cylinders 28. By placing the solenoid valve 56 only within the hydraulic circuit 70 to the boom lift cylinders 28, an operator may continue to manipulate the position of the bucket 26 through manipulation of the hydraulic circuit 80, even though the seat switch 52 is in the open of off position and the boom lift cylinders are rendered inoperable for further vertical movement. One skilled in the art will readily realize that only a portion of the hydraulic and electrical circuits pertaining to the instant invention have been shown in this schematic diagram of FIG. 8. Other circuitry will allow the continued operation of other components of the skid-steer loader 10, other than the boom structure 20, even though the seat switch 52 is in the open or off position effecting an inoperation of the hydraulic lift cylinders 28.

It will be understood that changes in the details, material, steps and arrangement of parts which have been described and illustrated to explain the nature of the invention will occur to and may be made by those skilled in the art upon a reading of this disclosure within the principals and scope of the invention. The foregoing description illustrates the preferred embodiments of the invention. However, concepts, as based upon such description, may be employed in other embodiments without departing from the scope of the invention. Accordingly, the following claims are intended to protect the invention broadly as well as in the specific form shown herein.

Having thus described the invention, what is claimed is:

1. In a loader having a mobile frame, including upwardly extending, laterally spaced sidewalls and a floor member extending between said sidewalls; a fore-and-aft extending boom structure pivotally mounted on said frame and including a pair of boom arms moveable along a generally vertical path adjacent said sidewalls; first power means operatively associated with said boom structure for moving said boom arms along said path of movement; and an operator's seat mounted on said floor member and having aseat frame supporting a seat cushion affixed thereto, the improvement comprising:

said seat frame having a first member connected to said loader frame and a second member spaced above said first member and vertically moveable relative thereto, said second member being affixed to said seat cushion and moveable between a first position adjacent said first member and a second position spaced from said first member, said second seat frame member being connected to said first seat frame member by a plurality of bolts slidably received through said first seat frame member, said bolts defining first and second spaced apart lines;

spring means positioned between said first and second seat frame members to bias said second member away from said first member, said spring means being further positioned between said first and second lines of bolts such that said first line of bolts is forwardly of said spring means and said second line of bolts is rearwardly of said spring means;

power interruption means operatively associated with said first power means to selectively cause said first power means to become inoperative and prevent said boom structure from being moved vertically, said power interruption means being selectively positionable between a first operative condition in which said first power means is free to operate within interruption by said power interruption means to vertically move said boom structure and a second operative condition in which said first power means is rendered inoperative to vertically move said boom structure; and switching means disposed between said first and second seat frame members and operatively connected to said power interruption means to sense the position of said second seat frame member relative to said first seat frame member and operatively control the position of said power interruption means betweein said first and second operative conditions in response to the position of said second member relative to said first member, so that said power interruption means is positioned in said first operative condition when said second seat frame member is in said first position and in said second operative condition when said second member is in said second position.

2. The loader of claim 1 wherein said switching means includes a switch mounted on said seat frame between said first and second seat frame members, adjacent said spring means and between said first and second lines of bolts, said switch being operable to move said power interruption means into said second operative condition to prevent the vertical movement of said boom structure when said second seat frame member is in said second position.

3. The loader of claim 2 wherein said second seat frame member is moveable into said first position whenever a weight is positioned on said seat to overcome the biasing force of said spring means urging said second seat frame member away from said first seat frame member, said seat having a forward portion forwardly of said first line of bolts and a rearward portion rearwardly of said second line of bolts, a weight distributed along said forward portion of said seat causing said second seat frame member to pivot about said second line of bolts and to move into said first position, a weight distributed along said rearward portion of said seat causing said second seat frame member to pivot about said first line of bolts and to move into said first position, a weight distributed generally between said forward and rearward portions of said seat causing a generally linear movement of said second seat frame member relative to said first seat frame member to move said second member into said first position.

4. The loader of claim 3 wherein said spring means comprises a spring capable of exerting a biasing force at least as great as the weight of that portion of the seat being biased upwardly away from said first seat frame member.

5. The loader of claim 4 wherein said second seat frame member includes a downwardly facing U-shaped bracket within which said spring is retained, said switch being affixed to the outside of said U-shaped bracket for convenient access thereto.

6. The loader of claim 5 wherein said second seat frame member has an aperture therein, said U-shaped bracket having a protrusion thereon corresponding to said aperture, said first seat frame member including an actuator plate spaced below said bracket, said switch being engageable with said actuator plate when said second seat frame member is in said first position, said spring being disposed between said actuator plate and said bracket and being operable to hold said bracket in position against said second seat frame member with said protrusion being engaged within said aperature to hold said bracket in a fixed position relative ro said second seat frame member.

7. The loader of claim 6 wherein said actuator plate has a forward edge and a remote rearward edge, said U-shaped bracket being disposed such that one downwardly depending leg is spaced forwardly of the other, said switch being mounted on said forward leg of said U-shaped bracket and engageable with said actuator plate adjacent said forward edge, said rearward leg of said U-shaped bracket being spaced rearwardly of said rearward edge of said actuator plate, said forward leg of said bracket being spaced above said actuator plate when said second seat frame member is in said first position.

8. The loader of claim 4 or 7 wherein said spring is disposed beneath the center of gravity of that portion of said seat biased upwardly by said spring.

9. The loader of claim 8 wherein said second seat frame member is spaced from said first seat frame member approximately 3/16 of an inch when said second seat frame member is in said second position.

* * * * *